US010858162B2

(12) United States Patent
Berman

(10) Patent No.: US 10,858,162 B2
(45) Date of Patent: Dec. 8, 2020

(54) PRODUCT CONTAINER WITH SPLIT RING

(71) Applicant: True Brands Limited, Ringwood (GB)

(72) Inventor: Lee Berman, Bournemouth (GB)

(73) Assignee: True Brands Limited, Ringwood (GB)

( * ) Notice: Subject to any disclaimer, the term of this patent is extended or adjusted under 35 U.S.C. 154(b) by 47 days.

(21) Appl. No.: 16/400,308

(22) Filed: May 1, 2019

(65) Prior Publication Data

US 2019/0337700 A1 Nov. 7, 2019

(51) Int. Cl.
*B65D 75/56* (2006.01)
*B65D 75/36* (2006.01)

(52) U.S. Cl.
CPC ..... *B65D 75/566* (2013.01); *B65D 75/36* (2013.01); *B65D 2575/565* (2013.01)

(58) Field of Classification Search
CPC .... B65D 75/566; B65D 75/565; B65D 75/36; B65D 2575/565
USPC ..... 206/461–471, 349
See application file for complete search history.

(56) References Cited

U.S. PATENT DOCUMENTS 3,297,290 A * 1/1967 Patterson ..... A47F 5/0068 248/222.12
4,020,694 A * 5/1977 Mayhew ..... B65D 85/38 374/189
4,084,692 A * 4/1978 Bilweis ..... D05B 91/14 206/403
4,195,739 A * 4/1980 Sweet, III ..... B65D 75/323 206/391
RE32,443 E * 6/1987 Kalal ..... B65D 75/54 206/348
4,669,610 A * 6/1987 Lindsey ..... B65D 75/54 206/320
5,248,036 A * 9/1993 Radocha, Sr. ..... A47F 5/0006 206/479
6,595,355 B1 * 7/2003 Hooper ..... A47G 25/005 206/292
7,350,645 B1 * 4/2008 Sills ..... A47F 5/0861 206/461
2002/0189955 A1 * 12/2002 Waters ..... A47F 7/021 206/5
2003/0217949 A1 * 11/2003 Schamante ..... B65D 73/0092 206/705
2006/0113205 A1 * 6/2006 Liu ..... B65D 75/54 206/349
2009/0261005 A1 * 10/2009 Kasubowski ..... B23D 59/00 206/349
2011/0017627 A1 * 1/2011 Wade ..... B65D 73/0092 206/464
2013/0062342 A1 * 3/2013 Hansen ..... B65D 43/169 220/4.22
2013/0233751 A1 * 9/2013 Hansen ..... B65D 73/0092 206/464
2016/0031624 A1 * 2/2016 Pascua ..... B32B 9/045 206/459.1

* cited by examiner

*Primary Examiner* — Chu Hoi Cheung
(74) *Attorney, Agent, or Firm* — Thorpe North & Western LLP

(57) ABSTRACT

A package is disclosed that has a support sheet with a cut-out. A product container supported by a locating sheet is held against at least one face of the support sheet. A split ring is carried by opposite faces of the support sheet and the locating sheet and disposed about the cut-out.

18 Claims, 1 Drawing Sheet

PRODUCT CONTAINER WITH SPLIT RING

PRIORITY CLAIM

The present application claims priority to GB patent application number 1807140.7 filed in the United Kingdom on May 1, 2018 entitled "Product Container with Split Ring" which is incorporated herein by reference in its entirety.

TECHNICAL FIELD

The present invention relates to packaging.

BACKGROUND

It is common to provide product containers such as blister packs for small items (for example, pocket tools) in which an aperture in for example, a sheet of cardboard surrounding the blister is used to hang the pack from a display hook, for example, a euro hook. In a retail environment a display will typically include an array of such hooks each carrying multiple packages of this type. However it is common for the cardboard around the aperture to tear as a result of handling by customers and staff, and the apertures are often quite small, which makes it hard for staff to hang the packages on the hooks quickly and easily. The larger the aperture, the weaker the support and the greater the risk of breakage. Many metal items, such as pocket tools for example, are designed to be attached to a split ring such as a key ring or the like.

SUMMARY

Accordingly the present invention provides a pack comprising a supporting sheet having a cut-out in one edge thereof, a split ring carried by and engaging opposite faces of the supporting sheet adjacent the cut-out, and a product container which is supported by a locating sheet held against at least one face of the supporting sheet, the locating sheet engaging and being supported in use by the split ring.

In use, when a package comprising the above pack and an item contained in the container is suspended from a display hook, the locating sheet distributes the load of the package on the split ring and reduces the risk of tearing of the package. Preferably the cut-out registers with the interior of the split ring and enables the pack to be hung by the split ring. This feature further reduces the risk of tearing the supporting sheet.

In one aspect, the container is in the form of a blister or compartment formed in the supporting sheet. In another aspect, the blister or compartment protrudes through an aperture in the supporting sheet. In still another aspect, an aperture in the supporting sheet engages the periphery of the blister. These features enhance the strength of the blister pack.

In one aspect of the technology, the supporting sheet is formed of transparent plastics material. The locating sheet is folded over the supporting sheet. This feature makes it harder for the package to be disassembled and the contents of the blister taken while the package is hanging on a display hook. In another aspect, the locating sheet overlaps the supporting sheet and confronting overlapping peripheral portions of the locating sheet are mutually attached (for example, by gluing) so as to sandwich the supporting sheet between opposite portions of the locating sheet. In another aspect, the supporting sheet has two opposite long edges and the locating sheet has confronting overlapping peripheral portions overlapping each long edge of the supporting sheet. In another aspect, the locating sheet is folded over a short edge of the supporting sheet opposite said cut-out. The above features further enhance security.

In one aspect, the cut-out is generally keyhole-shaped and the locating sheet includes an aperture within which the split ring is located. In another aspect, the split ring includes a mid plane between two turns thereof and has a transition region between the two turns which is cut by the mid-plane and which is bounded by opposite edges of the cut-out in the locating sheet. This feature prevents distortion of the locating sheet out of planarity and ensures a neat appearance of the blister pack.

In one aspect, the locating sheet is formed of paperboard, cardboard or the like. The technology also provides a package comprising a blister pack or compartment as defined above and a metal item (for example, a pocket tool) enclosed within the compartment or container of the blister pack. In one aspect, the metal item (for example, a pocket tool) has an attachment portion to which said split ring can be attached. The technology also provides a kit of parts for the pack of the invention, the kit comprising a supporting sheet, container, locating sheet and split ring as defined above.

BRIEF DESCRIPTION OF THE DRAWINGS

Certain aspects of the technology are described below, by way of example only, with reference to FIGS. 1 to 6 of the accompanying drawings, wherein.

DETAILED DESCRIPTION OF EXEMPLARY ASPECTS OF THE TECHNOLOGY

The following detailed description of exemplary aspects of the technology makes reference to the accompanying drawings, which form a part hereof and in which are shown, by way of illustration, exemplary aspects in which the technology may be practiced. While these exemplary aspects are described in sufficient detail to enable those skilled in the art to practice the technology, it should be understood that other aspects may be realized and that various changes to the technology may be made without departing from the spirit and scope of the present invention. Thus, the following more detailed description of the aspects of the present technology is not intended to limit the scope of the invention, as claimed, but is presented for purposes of illustration only and not limitation to describe the features and characteristics of the present technology, to set forth the best mode of operation of the technology, and to sufficiently enable one skilled in the art to practice the invention.

Figure 1:
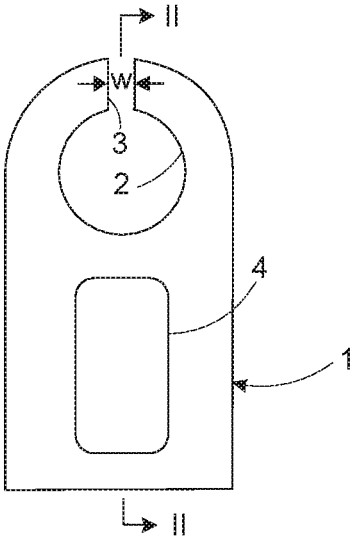
FIG. 1 is a front elevation of a laminar supporting sheet of a package in accordance with one aspect of the technology.
Figure 2:
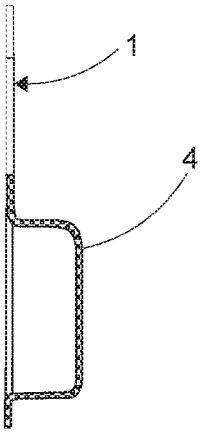
FIG. 2 is a cross-section taken on II-II of FIG. 1.

Referring to FIGS. 1 and 2, a generally rectangular supporting sheet 1 is disclosed made of thermoformed plastics, for example polystyrene. The supporting sheet has a generally keyhole-shaped cut- out formed in its rounded upper edge portion. The cut-out has a slot portion 3 of width W which expands into a circular aperture portion 2. A blister (i.e., a compartment or container, for example) 4 is formed in the lower portion of the supporting sheet 1.

Figure 3:
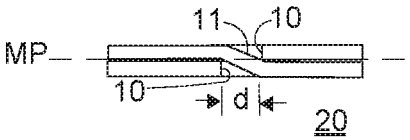
FIG. 3 is a front elevation of a split ring of the package.
Figure 4:
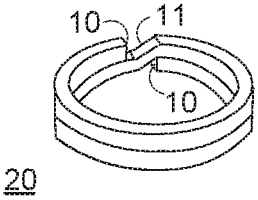
FIG. 4 is a rear perspective view of the split ring of FIG. 3.

As shown in FIGS. 3 and 4 (which are on an enlarged scale relative to FIGS. 1 and 2 in order to improve clarity) a split ring 20, which, in one aspect, is made of springy metal such as stainless steel, comprises two closely adjacent turns which terminate in respective ends 10 and an inclined transition portion 11 which is cut by the mid plane MP at the interface of the two turns. The length of the transition portion in the direction of the mid plane is D, where the length of D is greater than the width W. In this manner, outside the region occupied by the transition portion 11, a planar sheet can be fitted between the two turns of the split ring. The gap of width W accommodates (i.e., is bridged by) the transition region 11. The spacing between the ends 10 is also equal to D in one aspect of the technology, but could be greater as suits a particular purpose.

Figure 5:
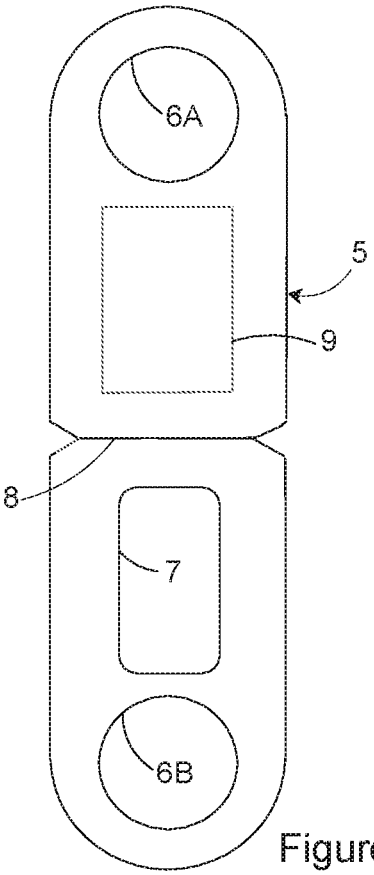
FIG. 5 is a front elevation of a locating sheet (in its unfolded state) of the package.

The locating sheet 5 shown in FIG. 5 is, in one aspect, made of cardboard, paperboard, or the like and has printing on the rear surface of at least its lower leaf giving details of an item 22 (FIG. 6) to be contained in the blister 4 (FIGS. 1 and 2). The locating sheet 5 has a fold line 8 and its periphery is symmetrical about this fold line. It includes two symmetrically disposed circular apertures 6A and 6B which are dimensioned to fit the exterior of the split ring 20 and to engage respective turns of the split ring 20 behind and in front of the supporting sheet 1.

A generally rectangular aperture 7 in the lower leaf of the locating sheet is located and dimensioned to fit closely around the blister 4 in the assembled package. A colored region 9 of the upper leaf of the locating sheet is disposed so as to lie behind the blister when the two leaves of the locating sheet are folded together and thereby provides a colored background to highlight the item in the blister package.

Figure 6:
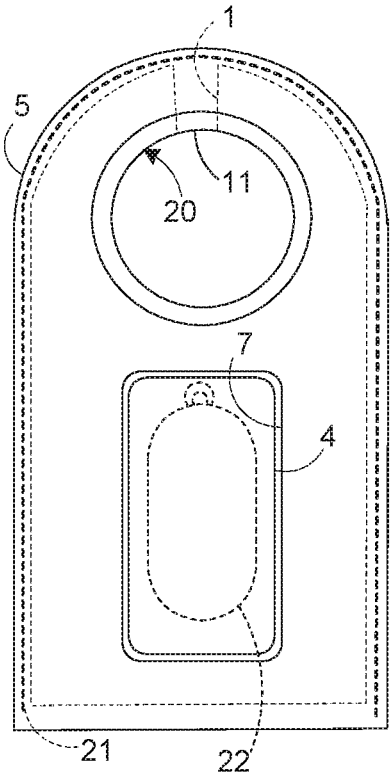
FIG. 6 is a front elevation of the assembled package.

In one aspect, the width of the locating sheet 5 is slightly greater than that of the supporting sheet 1. As shown in FIG. 6, the package is assembled by sliding the split ring 20 over the keyhole-shaped aperture (2, 3) of the supporting sheet 1 with the transition portion located between the facing edges of slot portion 3, loading a metal item 22 (for example, a pocket tool having an attachment portion for the split ring) in the blister 4, and then folding the locating sheet 5 over the lower edge of the supporting sheet so that blister 54 protrudes through and engages aperture 7 and circular apertures 6A and 6B fit around the split ring 20 behind and in front of the supporting sheet 1 respectively.

For ease of illustration, a slight gap is shown between aperture 7 and the periphery of blister 4, but in most aspects of the technology, the blister 4 will fit closely within aperture 7. The facing peripheral portions of the locating sheet 5 overlap the edges of the supporting sheet 1 and are glued together by glue bead 21 to sandwich the supporting sheet 1 between the two leaves of the locating sheet 5. The aperture 2 registers (or engages) with the interior periphery of split ring, so that when the package is hung from a display hook, the split ring 20 bears directly on the display hook and protects the package from damage by the hook.

The weight of the package is transferred by the blister 4 to the aperture 7 of the locating sheet 5 which in turn rests on the upper portion of the split ring 20 (for example, the portion of ring 20 facing away from the blister) at apertures 6A and 6B. The split ring distributes the weight over these apertures and thereby minimizes the risk of tearing the cardboard or paperboard material of the locating sheet 5. In other embodiments the blister 4 can be substituted by another form of container (for example, formed of folded cardboard or the like). In further variants, the cut-out can be formed in an edge other than the upper edge of the supporting sheet 1, for example in either lateral edge (for example, one of the long edges of a rectangular supporting sheet) or in the lower edge.

The foregoing detailed description describes the technology with reference to specific exemplary aspects. However, it will be appreciated that various modifications and changes can be made without departing from the scope of the present technology as set forth in the appended claims. The detailed description and accompanying drawings are to be regarded as merely illustrative, rather than as restrictive, and all such modifications or changes, if any, are intended to fall within the scope of the present technology as described and set forth herein.

More specifically, while illustrative exemplary aspects of the technology have been described herein, the present technology is not limited to these aspects, but includes any and all aspects having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the technology should be determined solely by the appended claims and their legal equivalents, rather than by the descriptions and examples given above.

The invention claimed is:

1. A package, comprising:

a support sheet having a cut-out;

a product container supported by a locating sheet held against at least one face of the support sheet;

a split ring carried by opposite faces of the support sheet and the locating sheet, said split ring disposed about the cut-out; and wherein the split ring is disposed above the product container.

2. The package according to claim 1 wherein the cut-out registers with an interior of the split ring and enables the package to be hung by the split ring.

3. The package according to claim 1, wherein the product container comprises a blister formed in the support sheet.

4. The package according to claim 3, wherein the blister protrudes through an aperture in the support sheet.

5. The package according to claim 4, wherein the aperture in the support sheet engages a periphery of the blister.

6. The package according to claim 1, wherein the support sheet comprises transparent plastic.

7. The package according to claim 1, wherein the locating sheet is folded over the support sheet.

8. The package according to claim 7, wherein the locating sheet overlaps the support sheet and confronting overlapping peripheral portions of the locating sheet are mutually attached so as to sandwich the support sheet between opposite portions of the locating sheet.

9. The package according to claim 8, wherein the support sheet has two opposite long edges and the locating sheet has confronting overlapping peripheral portions overlapping each long edge of the support sheet.

10. The package according claim 9, wherein the locating sheet is folded over a short edge of the support sheet opposite said cut-out.

11. The package according to claim 1, wherein the cut-out is generally keyhole-shaped.

12. The package according to claim 1, wherein the locating sheet includes an aperture within which the split ring is located.

13. The package according to claim 1, wherein the split ring includes a mid plane between two turns thereof and has a transition region between the two turns which is cut by the mid-plane and which is bounded by opposite edges of the cut-out in the locating sheet.

14. The package according to claim 1, wherein the locating sheet comprises paperboard or cardboard.

15. The package according to claim 1, further comprising a metal item enclosed within the product container.

16. The package according to claim 15 wherein the metal item has an attachment portion to which the split ring can be attached.

17. The package according to claim 15, wherein said metal item is a pocket tool.

18. A kit of parts for a package, comprising:

a support sheet, a container, a locating sheet, and a split ring, wherein when assembled the package comprises the support sheet having a cut-out, the container supported by a locating sheet held against at least one face of the support sheet, the split ring carried by opposite faces of the support sheet and the locating sheet, said split ring disposed about the cut-out.

* * * * *